US006505868B1

(12) United States Patent
Woroniec

(10) Patent No.: US 6,505,868 B1
(45) Date of Patent: Jan. 14, 2003

(54) WADDED DOCUMENT EXTRACTOR

(75) Inventor: Richard Woroniec, Brighton, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/841,390

(22) Filed: Apr. 24, 2001

(51) Int. Cl.[7] ..... B25B 33/00
(52) U.S. Cl. ..... 294/1.1; 81/488
(58) Field of Search ..... 294/1.1, 2; 81/487, 81/488; 132/323–325

(56) References Cited

U.S. PATENT DOCUMENTS

D211,880 S * 8/1968 Giuseppe ..... 132/324
3,734,107 A 5/1973 Thierman
5,246,021 A * 9/1993 Katz ..... 132/323
5,823,207 A * 10/1998 Bushman ..... 132/323
5,931,171 A * 8/1999 Landis et al. ..... 132/323
6,161,556 A * 12/2000 Gutierrez ..... 132/324
6,168,218 B1 1/2001 Raupp et al.

* cited by examiner

*Primary Examiner*—Dean J. Kramer
(74) *Attorney, Agent, or Firm*—Harness Dickey & Pierce, P.L.C.; Lisa A. Rode; Mark T. Starr

(57) ABSTRACT

A device and method for extracting wadded documents from a track of a document processor is provided. The device has a longitudinal body portion with surfaces defining an extraction aperture. The body portion also has ends defining an opening in the extraction aperture and surfaces defining a channel, wherein the channel extends between the ends. The extraction device further includes a tension member disposed within the channel and extending across the opening in the extraction aperture. The body portion further includes a securing member for placing the tension member under a desired tension such that damage to the track is avoided.

6 Claims, 5 Drawing Sheets

WADDED DOCUMENT EXTRACTOR

BACKGROUND OF THE INVENTION

1. Technical Field

The present invention generally relates to the servicing of document processing systems. More particularly, the invention relates to a document extraction device for extracting wadded documents and other debris from a stationary track of a document processor without damaging the track.

2. Discussion

It is well documented that banks, credit unions and other financial institutions regularly process checks, deposit slips and other types of banking documents in order to execute financial transactions efficiently. Automated document processing systems have therefore become quite prevalent in the industry. It is common for these systems to have various processing components (such as read heads, print heads, or optical reading devices) as well as various transport systems to expose the documents to the processing components.

Most document transport systems involve using narrow vertical tracks having walls with a vertical height similar to that of the documents. The track walls typically include apertures of various shapes and sizes to permit driving mechanisms (such as rollers, belts, etc.) to drivingly-contact documents in the track. While the tracks are preferably straight for ease of construction and improved document flow, they may also include turns and corners.

It has been determined that consistent feeding and driving of documents is obtained if the channel defined by the track walls has a very small lateral width relative to its height. Optimal track width, however, usually varies with document speed. For example, the nominal track width of the DP1800 document processor (commercially available from Unisys Corporation), with a track speed of 300 inches per second, is 0.10 inches (2.5 mm). At lower speeds, narrower track widths may be employed with consequent improvement in document handling and alignment. As speeds increase, the track width must be increased somewhat, since the increased kinetic energy of the document makes it more likely to jam if the track is too narrow. Nevertheless, the typical track width is on the order of 10–20 times the document thickness.

A particular concern regarding the above-described track arrangements, is the occurrence of document wadding. Document wadding is affected by a number of factors such as document weight, document speed, and paper quality. Thus, light-weight, poor quality paper traveling at high speeds are particularly prone to wadding. It is important to note that document wadding is often very destructive, because the machine cannot be stopped quickly enough to avoid driving subsequent documents into the jam-site. The result is typically the destruction of documents, which are crushed, folded and torn. Furthermore, the machine may be rendered unserviceable for extended periods of time while the track is cleared and the involved documents are accounted for.

Although a number of servicing techniques have been developed over the years, certain difficulties remain. For example, one approach has been to construct and adapt the document track as to make one or more of the track walls hinged (i.e., non-stationary) so that operators can open the track and access wadded documents. While this technique is acceptable in cases in which there is adequate access to the track and its contents, often times access is limited (e.g., blocked by machine parts such as a read element).

Furthermore, this technique may require that the driving rollers and belts also be made demountable. This requirement can result in the mechanisms being unduly complex, costly and more prone to failure. Additionally, the integral nature of certain processing components such as print heads, optical heads, and magnetic read heads, prohibits these components from being mobile.

Another approach has been to use various hooks and other devices to probe the closed sections of a jammed track in an effort to dislodge and extract documents and debris. Devices such as wire coat hangers, spring-hooks, button-hooks and knitting needles have all been used for this purpose. The results of the use of such techniques has often been unacceptable damage to the track—particularly with regard to delicate processing components such as read heads, print heads, and optical reading devices (incorporated along the track). It is therefore desirable to provide a method and device for extracting wadded documents and other debris from a stationary track without damaging the track.

The above and other objectives are provided by a document extraction device having a longitudinal body portion with surfaces defining an extraction aperture. The body portion also has ends defining an opening in the extraction aperture and surfaces defining a channel, wherein the channel extends between the ends. The extraction device further includes a tension member disposed within the channel and extending across the opening in the extraction aperture. The body portion further includes a securing member for placing the tension member under a desired tension such that the extraction device provides a mechanism for extracting wadded documents from a stationary track of a document processor without damaging the track.

Further in accordance with the present invention, a longitudinal body portion of a document extraction device is provided. The body portion has a first half including a first pair of longitudinal members and a first step region. The first step region has a first external surface defining a first portion of a channel. A second half includes a second pair of longitudinal members and a second step region. The second step region has a second external surface defining a second portion of the channel. The body portion further includes an adhesive for coupling the first half to the second half such that internal surfaces of the longitudinal members define an extraction aperture.

In another aspect of the invention, a method for extracting a wadded document from a track of a document processor is provided. The method includes the step of providing a hand-held document extraction device having surfaces defining an extraction aperture and a tension member extended across an opening in the extraction aperture. The tension member is moved from a first side of the track to a second side of the track such that the tension member crosses an interface between the wadded document and a wall of the track. The method further provides for moving the tension member from the second side of the track to the first side of the track such that the tension member pulls the wadded document out of the track without damaging the track.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute part of this specification. The drawings illustrate various features and embodiments of the invention, and together with the description serve to explain the principles and operation of the invention.

BRIEF DESCRIPTION OF THE DRAWINGS

The various advantages of the present invention will become apparent to one skilled in the art by reading the following specification and sub-joined claims and by referencing the following drawings, in which:

DETAILED DESCRIPTION OF THE PREFERRED EMBODIMENTS

The following description of the preferred embodiment(s) is merely exemplary in nature and is in no way intended to limit the invention, its application, or uses.

Figure 1B:
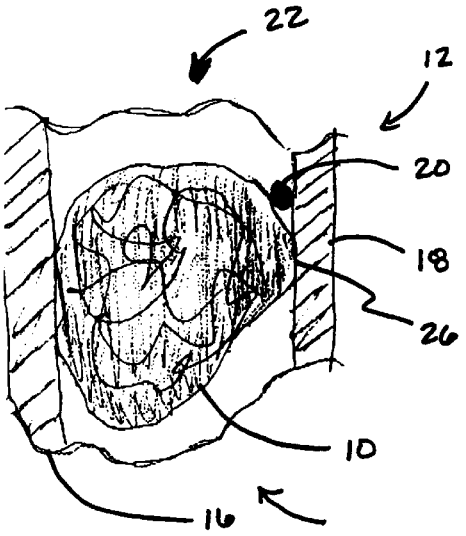
FIG. 1B is an enlarged view of area 1B shown in FIG. 1A.
Figure 1A:
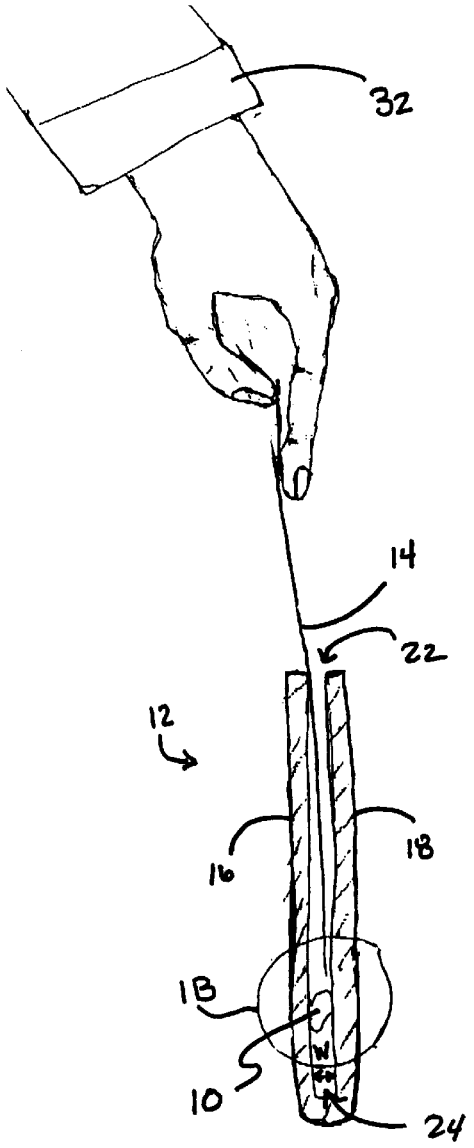
FIG. 1A is an end view of a document processor track having a wadded document and illustrating a method for extracting the wadded document from the track in accordance with the principles of the present invention.

Turning now to FIG. 1A, it can be seen that the present invention provides a unique method and device for extracting a wadded document 10 from a track 12 of a document processor (not shown). While the present invention will be primarily described with respect to document processors commonly used in the financial industry, the invention is not so limited. Thus, the hand-held document extraction device 14 can be useful in any environment in which the track 12 has a relatively narrow width w, and particularly in which the walls 16, 18 are stationary (i.e., not demountable).

Figure 2:
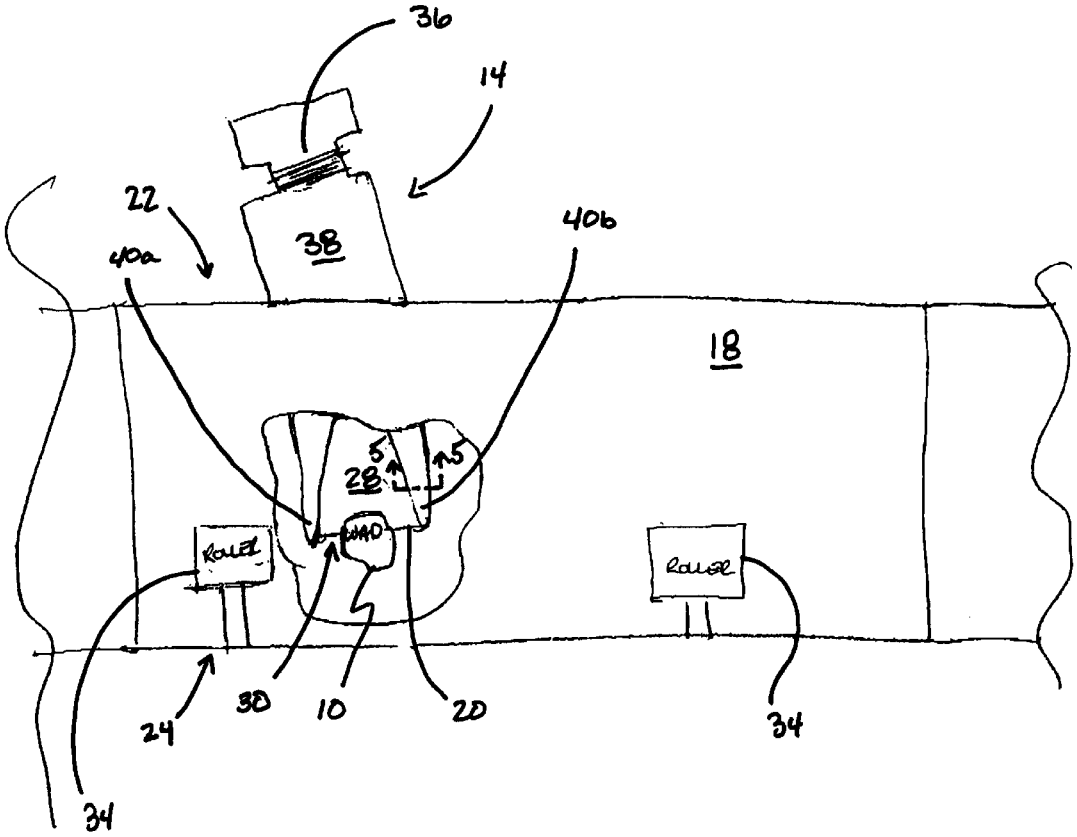
FIG. 2 is a cut-away view of the track shown in FIGS. 1A and 1B.

Notwithstanding, FIGS. 1A, 1B, and 2 demonstrate that the extraction device 14 has surfaces defining an extraction aperture 28 and a tension member 20 extended across an opening 30 in the extraction aperture 28. Thus, by moving the tension member 20 from an open area (i.e., first area) 22 of the track 12 to a closed area (i.e., second area) 24 of the track 12, the tension member 20 crosses an interface 26 between the wadded document 10 and a wall of the track 12 such as wall 18. This enables an operator 32 to move the tension member 20 from the second area 24 of the track 12 to the first area 22 of the track 12 such that the member 20 pulls the wadded document 10 out of the track 12 without damaging the track 12. Simply put, the operator 32 can freely move the tension member 20 under the bulk of the wadded document 10 (provided there is clearance between the second area 24 and the document 10) and extract it by pulling up.

It should be noted that the preferred approach is to select the location of the interface 26 to be a point in which there is a minimum amount of force between the document 10 and the track walls. This approach is preferred in order to avoid moving the wad down and further jamming it. It can be seen that the extraction device 14 enables the avoidance of damage to adjacent components such as rollers 34, which extend into the track through apertures in the wall 18. It can further be seen that the tension member 20 can be wrapped around a securing member 36 of the extraction device 14 such that the tension member 20 is placed under a desired tension.

Figure 5:
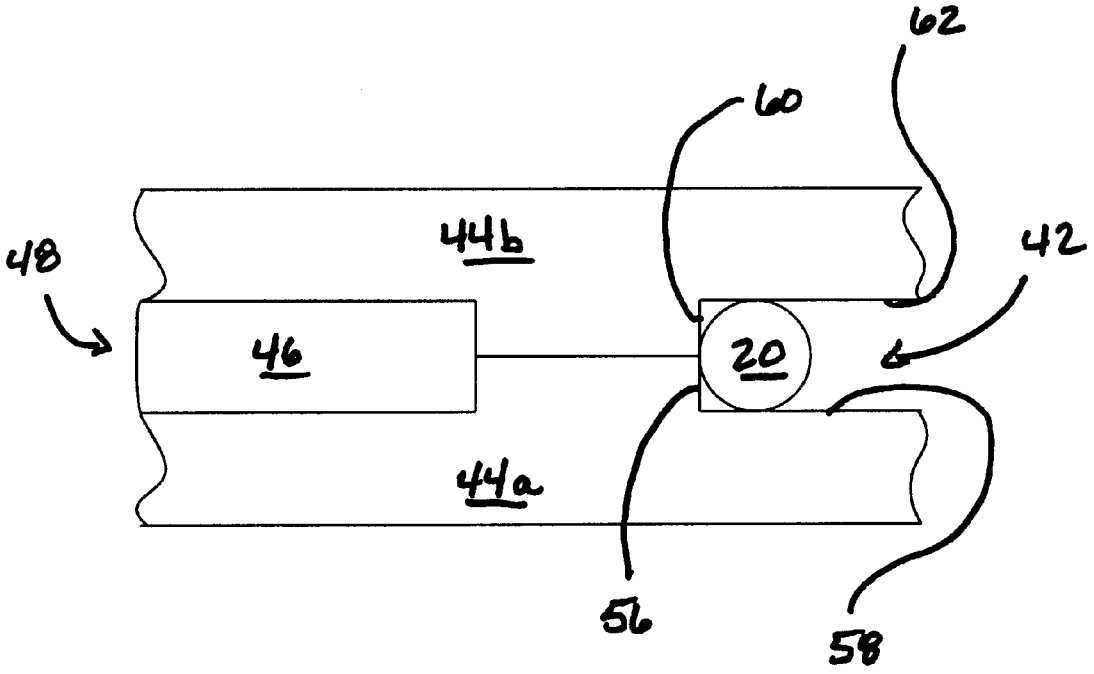
FIG. 5 is an enlarged sectional view taken along lines 5—5 shown in FIG. 2.

Turning now to FIGS. 2 and 5, the construction of the extraction device 14 will be described in greater detail. Generally, it can be seen that the device 14 has a longitudinal body portion 38 and the tension member 20 already discussed. The longitudinal body portion 38 has surfaces defining the extraction aperture 28, ends 40*a*,40*b* defining an opening 30 in the extraction aperture 28, and surfaces defining a channel 42, wherein the channel 42 extends between the ends 40*a*,40B. The tension member 20 is disposed within the channel 42 and extends across the opening 30 in the extraction aperture 28. The body portion 38 also has a securing member 36 for placing the tension member 20 under the desired tension such that the extraction device 14 provides a mechanism for extracting wadded documents from a stationary track of a document processor without damaging the track.

As best seen in FIG. 5, the body portion has a first half 44*a* and an identical second half 44*b*. It can be seen that the body portion further includes an adhesive 46 for coupling the first half 44*a* to the second half 44*b*, wherein each half has surfaces defining a portion of an internal cavity 48 for receiving the adhesive 46.

Figure 3:
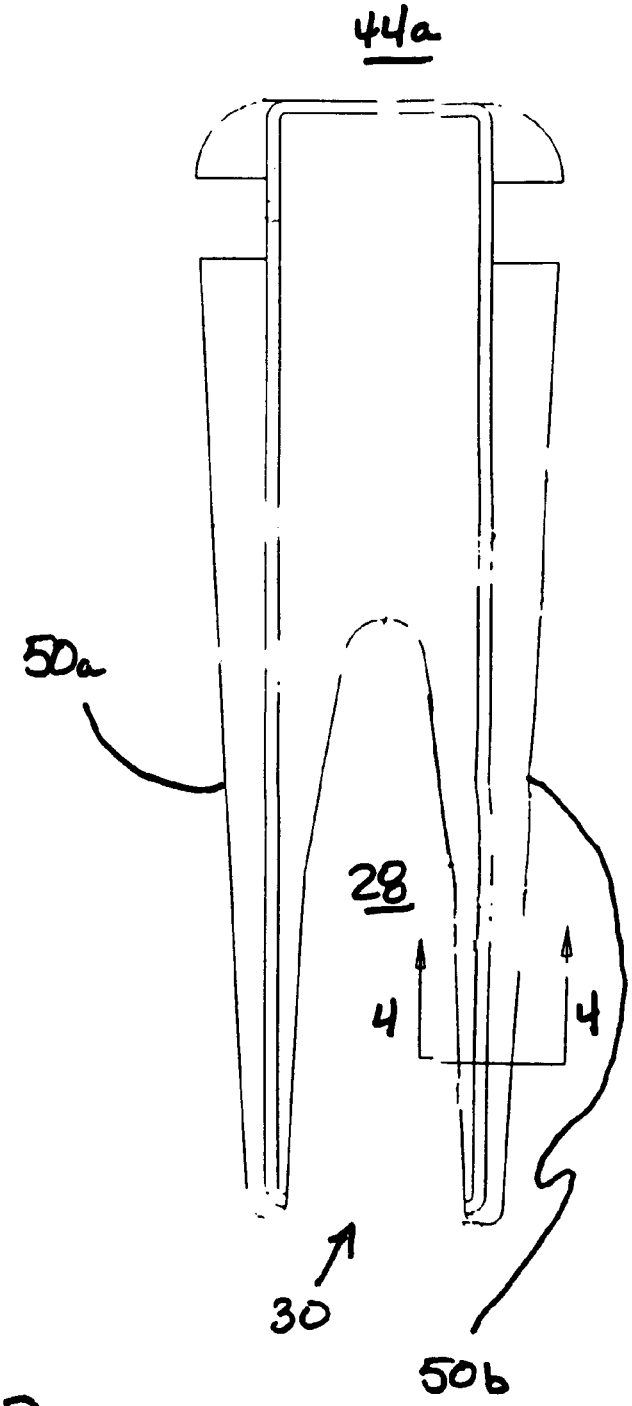
FIG. 3 is a top view of half of a document extraction device in accordance with the principles of the present invention.
Figure 4:
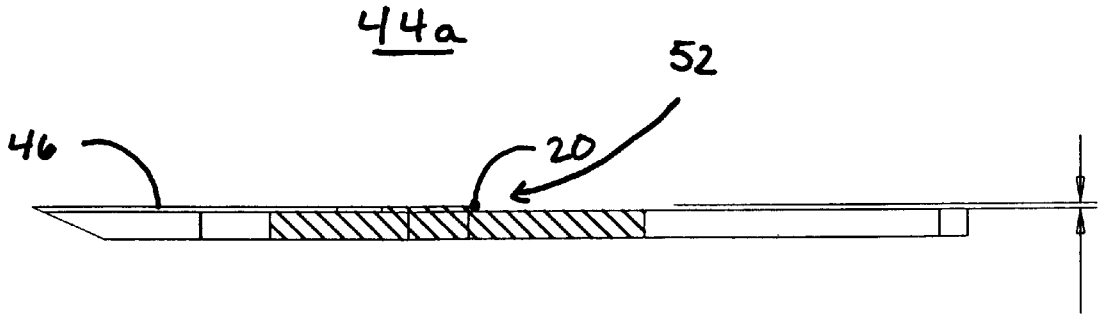
FIG. 4 is an enlarged sectional view taken along lines 4—4 shown in FIG. 3.

Since the halves 44*a*,44*b* are identical, FIGS. 3 and 4 only illustrate the first half 44*a*, with the understanding that the second half 44*b* is similarly constructed. FIGS. 3–5 demonstrate that the first half 44*a* has a first pair of longitudinal members 50*a*, 50*b* and a first step region 52, where the first step region 52 has first external surfaces 56,58 defining a first portion of the channel 42. Similarly, the second half 44*b* has a second pair of longitudinal members and a second step region, where the second step region has second external surfaces 60,62 defining a second portion of the channel 42.

It will be appreciated that the tension member 20 is preferably made of a multi-stranded, wrapped material with a high breaking strength such as dental floss. Materials such as thread may be used, but are less preferred due to their relatively low breaking strength. Furthermore, materials such as music wire may be used but are less preferred due to the occurrence of "kinks" resulting from their relatively low elastic limit. The body portion is preferably made of plastic shims (e.g., polycarbonate) that are machined to obtain both the channel 42 containing the tension member 20 as well as the internal cavity 48 containing the adhesive 46. The key design parameter for selecting the body portion material is achieving a satisfactory level of buckling resistance. Furthermore, it is important to design the body portion 38 to have a very narrow thickness, (such as 0.04") in order to enable the extraction device 14 to be used with conventional document processors. Additionally, the extraction aperture 28 has a predetermined width based on an anticipated maximum size of the wadded documents.

It should also be noted that the securing member 36 is shown as having a "notch" shape, but other shapes may be used. In particular, the securing member 36 can be designed to enhance the ergonomics of the device 14. Thus, the securing member 36 may be adapted to better mesh with the hand of operator 32.

Those skilled in the art can now appreciate from the foregoing description that the broad teachings of the present invention can be implemented in a variety of forms. Therefore, while this invention can be described in connection with particular examples thereof, the true scope of the invention should not be so limited since other modifications will become apparent to the skilled practitioner upon a study of the drawings, specification and following claims.

What is claimed:

1. A document extraction device comprising:

a longitudinal body portion having surfaces defining an extraction aperture, ends defining an opening in the extraction aperture, and surfaces defining a channel wherein the channel extends to each end; and a tension member disposed within the channel and extending across the opening in the extraction aperture;

said body portion having a securing member for placing the tension member under a desired tension such that the extraction device provides a mechanism for extracting wadded documents from a stationary track of a document processor without damaging the track wherein the body portion includes:

a first half having a first pair of longitudinal members and a first step region, the first step region having first external surfaces defining a first portion of the channel;

a second half having a second pair of longitudinal members and a second step region, the second step region having second external surfaces defining a second portion of the channel; and an adhesive for coupling the first half to the second half such that internal surfaces of the longitudinal members define the extraction aperture.

2. The extraction device of claim 1 wherein the first half further includes surfaces defining a first portion of an internal cavity for receiving the adhesive.

3. The extraction device of claim 2 wherein the second half further includes surfaces defining a second portion of the internal cavity for receiving the adhesive.

4. A document extraction device having a longitudinal body portion, the body portion comprising:

a first half having a first pair of longitudinal members and a first step region, the first step region having first external surfaces defining a first portion of a channel;

a second half having a second pair of longitudinal members and a second step region, the second step region having second external surfaces defining a second portion of the channel; and an adhesive for coupling the first half to the second half such that internal surfaces of the longitudinal members define an extraction aperture.

5. The document extraction device of claim 4, wherein the first half of the longitudinal body portion further includes surfaces defining a first portion of an internal cavity for receiving the adhesive.

6. The document extraction device of claim 5, wherein the second half of the longitudinal body portion further includes surfaces defining a second portion of an internal cavity for receiving the adhesive.

* * * * *